US006095248A

United States Patent [19]

Freeman

[11] Patent Number: 6,095,248

[45] Date of Patent: Aug. 1, 2000

[54] METHOD AND APPARATUS FOR REMOTE CONTROL OF A TUBING EXIT SLEEVE

[75] Inventor: Tommie A. Freeman, Flower Mound, Tex.

[73] Assignee: Halliburton Energy Services, Inc., Dallas, Tex.

[21] Appl. No.: 09/185,384

[22] Filed: Nov. 3, 1998

[51] Int. Cl.[7] ..... E21B 17/00

[52] U.S. Cl. ..... 166/313; 166/50; 166/117.6; 166/242.3; 166/242.5

[58] Field of Search ..... 166/50, 117.5, 166/117.6, 242.1, 242.3, 242.5, 313

[56] References Cited

U.S. PATENT DOCUMENTS

| | | | |
|---|---|---|---|
| 5,231,352 | 7/1993 | Huber . | |
| 5,532,585 | 7/1996 | Oudet et al. . | |
| 5,547,029 | 8/1996 | Rubbo et al. . | |
| 5,666,050 | 9/1997 | Bouldin et al. . | |
| 5,730,224 | 3/1998 | Williamson et al. | 166/386 |
| 5,735,350 | 4/1998 | Longbottom et al. . | |
| 5,823,263 | 10/1998 | Morris et al. | 166/386 X |

FOREIGN PATENT DOCUMENTS

| | | |
|---|---|---|
| WO 97/41333 | 11/1997 | WIPO . |
| WO 98/40699 | 9/1998 | WIPO . |

OTHER PUBLICATIONS

PES Ltd. Surface Controlled Reservour Analysis and Management Systems; brochure; date unknown; Country unknown, 7 pp.

*Primary Examiner*—Roger Schoeppel
*Attorney, Agent, or Firm*—William M. Imwalle; Kevin L. Smith

[57] ABSTRACT

A remote-controlled tubing sleeve window for access to a lateral wellbore of a multilateral well. The tubing sleeve window has a tubular body portion that defines a side port that is sufficiently-sized to allow a well tool to pass. A sleeve is received in the tubing body portion such that it can reciprocate within the body portion. The sleeve is responsive to a remote command such that a side window defined in the sleeve can be substantially-aligned with the side port in an open relation such that a well tool can pass through said substantially-aligned side window and side port. A position sensor is also provided to sense a displacement of the sleeve with respect to the body portion.

20 Claims, 4 Drawing Sheets

METHOD AND APPARATUS FOR REMOTE CONTROL OF A TUBING EXIT SLEEVE

TECHNICAL FIELD

The present invention relates generally to subsurface well completion equipment, and in particular to a remotely controllable exit sleeve for multilateral wellbores.

BACKGROUND OF THE INVENTION

Hydrocarbon recovery volume from a vertically-drilled well can be increased by drilling additional wellbores from that same well. For example, the fluid recovery rate and the well's economic life can be increased by drilling a horizontal, or lateral, interval from a main wellbore into one or more formations. Still further increases in recovery and well life can be attained by drilling multiple horizontal intervals into multiple hydrocarbon-bearing formations.

Oil and gas production from hydrocarbon-bearing geological formations can yield high levels of salt and other elements that can seriously hamper the well production. The well casing extends down into the formation, and includes a plurality of perforations that extend laterally into the formation to permit the hydrocarbons to flow into the main wellbore. Production tubing, which extends through the casing, and packers are then used to conduct the hydrocarbon out of the well.

Salts and other elements from the formation tend to deposit in the production tubing and, more significantly, in the perforations that extend from the casing into the formation. Over time, deposits can accumulate in the perforation walls and along the flow path, significantly reducing the perforation diameters and in turn, reduce the production flow from the well. Also, over the life of the well, its production rate and the amounts of undesirable elements present in the hydrocarbon production varies.

Deposits of salt and other water-soluble elements can be removed and/or prevented by treating the well, such as by flushing the production tubing with solutions in which the deposits are soluble, or by injecting the solutions into the production tubing to dislodge the deposits.

Accordingly, access to the horizontal or lateral wellbores of a well on a maintenance basis is necessary to prolong the useful production life of a well. Sliding sleeves have been installed in multilateral wells adjacent the lateral bores, but manipulation of these units have been time consuming and added to the maintenance expense of a well. For example, before maintenance well tools could be lowered into the lateral wellbore, a coiled-tubing tool had to make a well trip to raise the side door. Next, the maintenance tool was lowered into the well to access the lateral wellbore so that well maintenance can be done. Also, the position of a side door has not been readily discernable from the surface, and must be determined from records concerning the configuration of the well, or an exploratory trip that may simply determine that the side door was in the necessary position.

Accordingly, there is a need for eliminating a downhole trip devoted for simply opening a sliding side door to access a lateral wellbore. Further, a need exists for determining the configuration of the side doors in a multilateral well from the surface without the need to perform an exploratory trip to determine the actual configuration of the well.

BRIEF SUMMARY OF THE INVENTION

Thus, provided is a remote-controlled tubing sleeve window for access to a lateral wellbore of a multilateral well.

The tubing sleeve window has a tubular body portion that defines a side port that is sufficiently-sized to allow a well tool to pass. A sleeve is received in the tubing body portion such that it can reciprocate within the body portion. The sleeve is responsive to a remote command such that a side window defined in the sleeve can be substantially-aligned with the side port in an open relation such that a well tool can pass through said substantially-aligned side window and side port.

In a further aspect of the invention, a position sensor is provided having an electrical output port. The position sensor is secured to the tubular body portion such that a longitudinal displacement of the sleeve, with respect to the tubular body portion, is sensed by the sensor. The sensor can then transmit a signal corresponding to the displacement through the electrical output port for receipt at a remote location.

BRIEF DESCRIPTION OF THE SEVERAL VIEWS OF THE DRAWING

The accompanying drawings are incorporated into and form a part of the specification to illustrate examples of the present invention. These drawings together with the description serve to explain the principles of the invention. The drawings are only included for purposes of illustrating preferred and alternative examples of how the inventions can be made and used and are not to be construed as limiting the inventions to only the illustrated and described examples. Various advantages and features of the present inventions will be apparent from a consideration of the drawing in which.

DETAILED DESCRIPTION OF THE INVENTION

Figure 1:
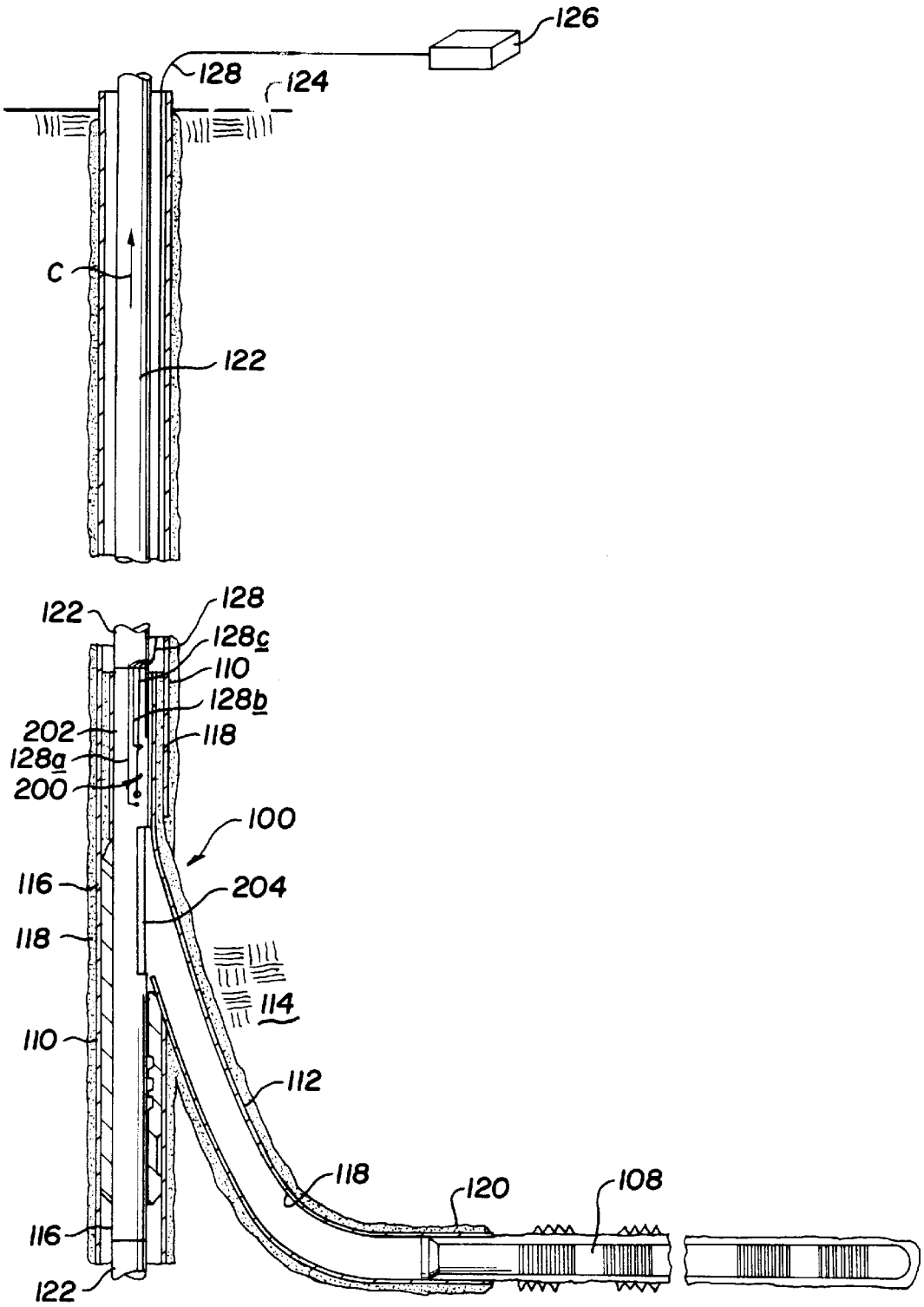
FIG. 1 is a cross-sectional schematic view of a tubing exit sleeve of the present invention deployed in a multilateral well.

The principles of the present invention and their advantages are best understood by referring to the illustrated embodiment depicted in the FIGURES, in which like reference numbers describe like parts. In the drawing and the accompanying description arrow "C" is used to indicate the upward or uphole direction. The reverse of arrow "C" refers to the downward or downhole direction. The upward and downward directions used herein are for reference purposes only, and it is appreciated that not all wells extend vertically, and that the present inventions have utility in non-vertical well configurations.

FIG. 1 is a cross-sectional schematic view of a remotely-controlled tubing exit sleeve of the present invention deployed in a multilateral well 100 having a main wellbore 110 and at least one lateral wellbore 112. Also shown is a production assembly 108 extending into the lateral wellbore 112.

The main wellbore 110 and the lateral wellbore 112 have been drilled into the earth 114, which is generally referred to as "material surrounding the wellbores." A main casing 116 is set into the main wellbore 110 with cement 118, using methods known to those skilled in the art.

The lateral wellbore 112 is formed using methods known in the art, such as that disclosed in U.S. Pat. No. 5,735,350 issued Apr. 7, 1998, to Longbottom et al., which is incorporated herein by reference for all purposes. The lateral wellbore has a lateral lining 118 set into the lateral wellbore 112 with lateral liner cement 120.

Shown threadingly coupled to the tubing string 122 is a remote-controlled tubing exit sleeve 200. The tubing exit sleeve 200 has a tubing body 202. Received within the tubing body 202 is an exit-window sleeve 204. The exit-window sleeve 204 is adjacent to the tubing body 202 and is in a substantially-coaxial relation with respect to the tubing body 202.

Shown in FIG. 1, the exit window sleeve 204 is in a closed position to block access from the inner bore of the tubing string 122 to the inner bore of the lateral liner 118. As described in detail below, the exit-window sleeve 204 is remote-controlled from the surface 124 by a microcontroller-based control system 126. The control system 126 is coupled with an electro-hydraulic downhole completion system that can be manipulated to modify the flow profile of the multilateral well 100.

A downhole communication and power cable 128 couples the microcontroller-based system 126 to the tubing exit sleeve 200 such that the tubing exit sleeve 200 is responsive to commands transmitted from the control system 126. The communication and power cable 128 is a dual-redundant umbilical line, each line having at least a return 128*a* and input hydraulic line 128*b*, and a one-wire conductor 128*c*. It should be noted, however, that other communication and power systems may be used to service and control the tubing exit sleeve 200. For example, electromagnetic transmission techniques or acoustic transmission techniques, which are known to those skilled in the art, can be used to control the tubing exit sleeve in combination with an uphole or downhole power supplies.

The hydraulic lines 128*a* and 128*b* provide a conduit for applying pressure from the surface 124 to the exit tubing sleeve 200 to exert a hydraulically-generated pressuredifferential force to mechanically operate the tubing exit sleeve 200. The l-wire can be used to carry commands from the control system 126 and command signals to the tubing exit sleeve 200. A high-frequency command and a comparatively lowfrequency power signal is transmitted through the conductor 128*c* wire, through a downhole microprocessor, which directs the hydraulic circuit in the tubing exit sleeve 200, to effect a change in the mechanical state of the tubing exit sleeve 200. An example of a downhole control system is discussed in further detail in U.S. Pat. No. 5,547,029, issued Aug. 20, 1996 to Rubbo et al., which is incorporated herein by reference.

Figure 2:
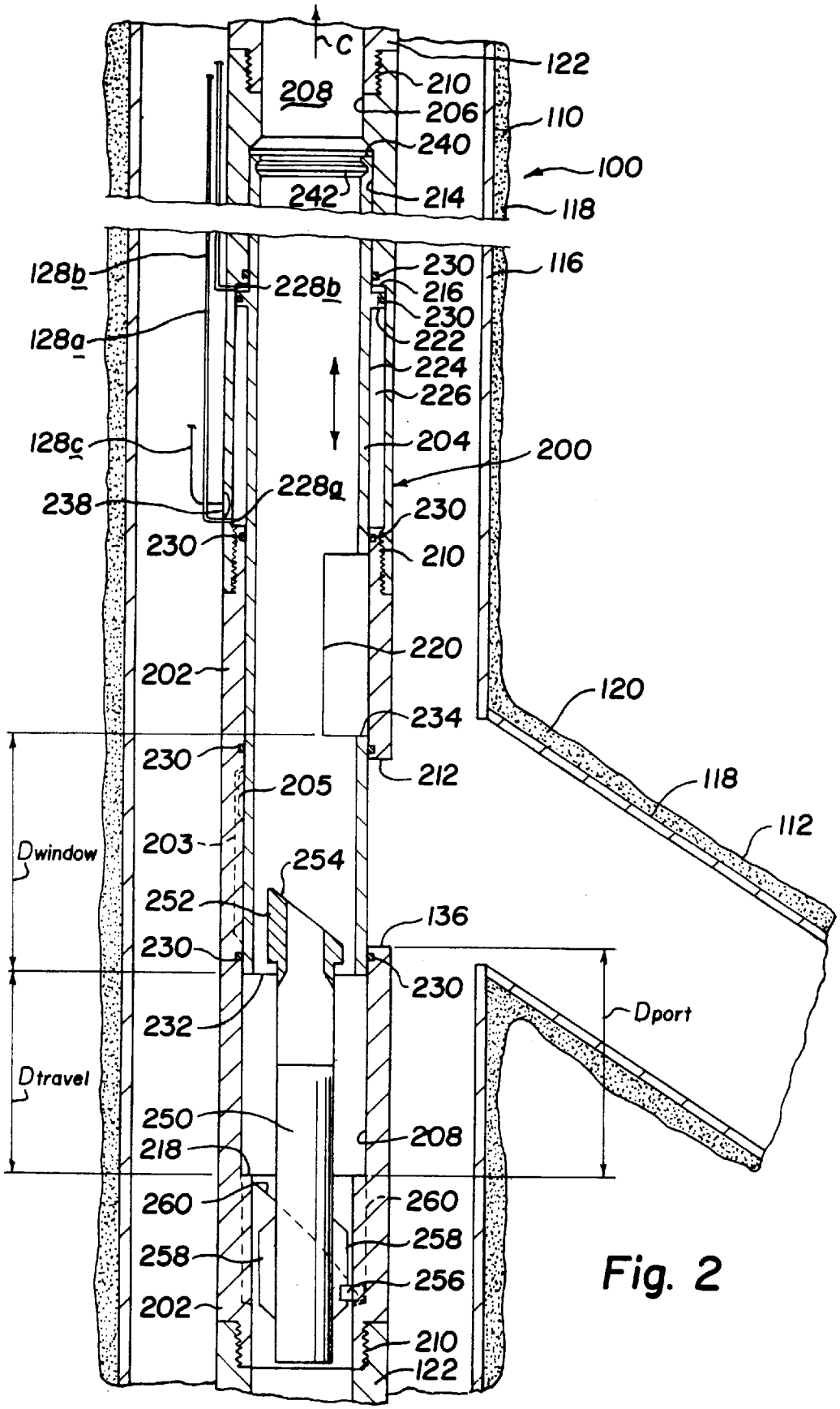
FIG. 2 is an enlarged cross-sectional schematic view of the tubing exit sleeve of the present invention deployed in a closed position.

FIG. 2 is an enlarged cross-sectional view of a tubing exit sleeve 200 of the present invention deployed in a closed position. The tubing exit sleeve 200 has a body portion 202, which has an inner surface 206 that defines a substantially cylindrical inner bore 208. Threads 210 matingly receive the tubing string 122 such that a well tool can be routed from the surface 124 (see FIG. 1) to the inner bore 208 of the tubing body portion 202.

Defined in the tubing body portion 202 is a side port 212. The side port is substantially aligned with the lateral wellbore 112 for access from the inner bore 208 in the nature of mechanical access with a well tool or fluid access.

Also defined in the tubing body portion 202 is an exit window sleeve recess 214. The sleeve recess 214 has an enlarged inner diameter $ID_{214}$ sufficient to receive the exit window sleeve 204 in a substantially-coaxial relation with respect to the tubing body 202. As shown, the inner diameter $ID_{204}$ of the exit window sleeve 204 is less than or equal to the inner diameter $ID_{202}$ of the tubing body portion 202 to minimize obstruction of the inner bore 208.

It should be noted that other configurations of the exit-window sleeve can be used, such as a partial sleeve that forms a partial tube that can be received in grooves of the tubing body portion 202. In other embodiments, the tubing sleeve can be received on the exterior of the body portion 202. Preferably, however, the window sleeve 204 is received within the tubing body 202.

The window sleeve 204 is rotationally-secured with the body portion 202 sufficient to maintain longitudinal alignment of a sleeve window 220, defined in the window sleeve 204, with the window port 212. For example, a radial outward-extending projection or key may be provided on the window sleeve 204 and cooperatively slidingly-engaged with a groove or keyway formed internally on the body portion 202 to prevent relative circumferential displacement between the window sleeve 204 and the body portion 202.

The exit window sleeve 204 can longitudinally reciprocate between a closed position limited by the recess shoulder 216, and an opened position limited by an opposing recess shoulder 218. The exit window sleeve 204 defines an exit window 220. The exit window 220 is dimensioned to accommodate well tools accessing the lateral wellbore 112. The window distance $D_{window}$ from a bottom end 232 of the window sleeve 204 to the bottom edge 234 of the sleeve window 220 is greater than the travel distance $D_{travel}$ between the open and closed position of the window sleeve 204. The distance $D_{port}$ from the shoulder 218 to the bottom edge 136 is greater than the travel distance $D_{travel}$, and is greater than or equal to the window distance $D_{window}$ such that the sleeve window 220 is substantially aligned with the side port 212 when the bottom edge 232 of the window sleeve 204 is adjacent the shoulder 218 in the opened position, discussed later in detail.

Driving the window sleeve between the open and closed position is provided by a hydraulically-responsive window sleeve piston 222, which is defined on the outer surface 224 of the window sleeve 204. The sleeve piston 222 is received in a longitudinally-extending piston chamber 226 defined in the tubing body portion 202. The cross-sectional profile of the sleeve piston 222 substantially-corresponds to the cross-sectional profile of the piston chamber 226.

The sleeve piston 222 is responsive to a fluid pressure differential within the piston chamber 226. The term "fluid" as used herein means a material capable of flowing, and may include gases, liquids, plastics, and solids that can be handled in the manner of a liquid and has characteristics suitable for hydraulic use. The piston chamber 226 and the sleeve piston 222 are in a sealed relation with seals 230. Suitable seals are provided by O-rings received in grooves defined in the body portion 202 or the exit-window sleeve 204, accordingly. The seals 230 are preferably formed of a durable metal alloy. The sleeve piston is driven by a fluid pressure-differential generated across the piston 222 by the return-hydraulic line 128*a* coupled to a return port 228*a*, and the input-hydraulic line 128*b* coupled to an input port 228*b*.

The position of the window sleeve 204 with respect to the tubing body portion 202 is sensed with a position sensor 238, such as inductance-shift sensor, or a magnetic position sensor. A magnetic-position sensor operates on the principal of shifts in magnetic fields, generally brought on by a magnetic field source reference. Preferably, the position sensor 238 is a magnetic position sensor.

The position sensor 238 as shown is of an exaggerated size to more clearly convey this aspect of the present invention. The position sensor is secured to the tubing body portion 202 such that it does not extend past the outer surface 207 of the tubing body portion 202 to minimize abrasive contact of the position sensor 238 with the casing 116 as the tool 200 is lowered into position.

Figure 3:
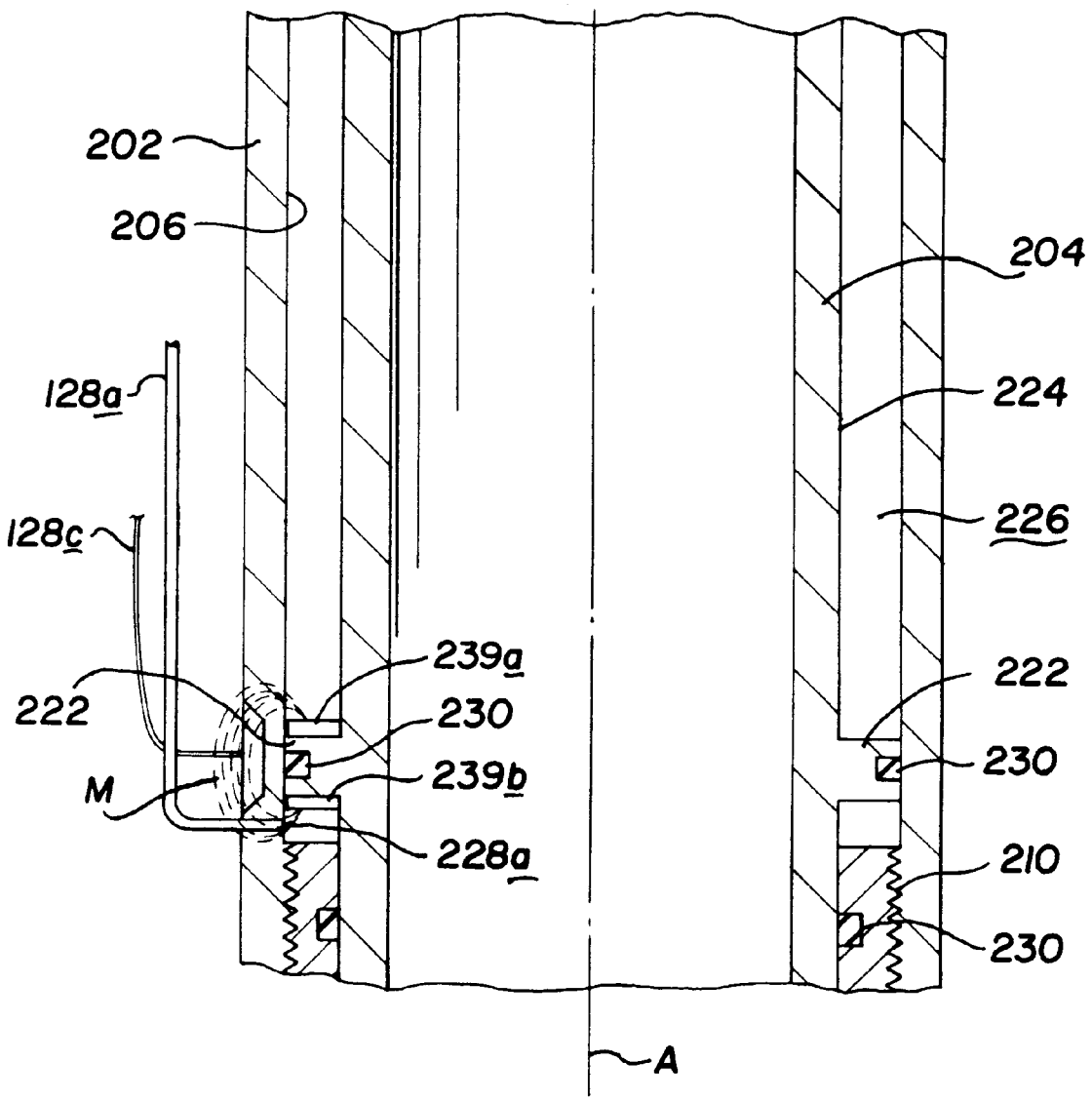
FIG. 3 is an enlarged illustration of the interaction between a position sensor and a magnetic field source of the present invention.

The magnetic field source 239 can be provided by a conventional magnet with a magnetic field strength sufficient to be sensed by the sensor 238. Referring to FIG. 3, an enlarged illustration shows the interaction between the position sensor 238 and the magnetic field source 239 is shown.

The region of the tubing body portion adjacent the sensor 238 is a magnetically-shielding steel ferromagnetic material. The window sleeve piston 222 has oppositely directed end faces, on which two magnets 239*a* and 239*b* are opposingly mounted adjacent the inner surface 106 of the tubing body portion 202. The respective magnetic axes are substantially longitudinally-aligned with the tubing body portion 202. The magnetic field source provided by the magnets 239*a* and 239*b* provides a magnetic main flux illustrated by magnetic flux lines M.

The position sensor 238 is disposed on the outer surface 207 of the tubing body portion 202 to sense the magnetic field source 239. Accordingly, displacement of the window sleeve piston 222 along the longitudinal axis A generates a variation of the strength of the magnetic field sensed by the position sensor 238. When the magnetic field source 239 is sensed, the position sensor 238 registers the magnetic field M, which is then used to produce a switching signal on sensor conductors 128*c* through an electrical output port or terminal. The electrical output of the position sensor 238 is transmitted to the surface control system 126 through the sensor conductor 128*c*. The electrical output is then processed to determine whether the window sleeve 204 is in the closed or the opened position. Further detail concerning position sensors is available in U.S. Pat. No. 5,231,352, issued Jul. 27, 1993 to Huber, which is incorporated herein by reference. It should be noted that other position sensing techniques of the exit window sleeve 204 with respect to the tubing body portion 202 can be deployed, such as that shown in U.S. Pat. No. 5,532,585, issued Jul. 2, 1996, to Oudet et al., which is incorporated herein by reference.

Accordingly, the advantage of the position sensor 238 is to determine, before a trip to the exit tubing sleeve 200, whether a tooling operation can be conducted. Conventionally, the manipulation of multilateral equipment is done blind in that a series of commands are transmitted for a mechanical operation; but until well tools are sent downhole, it is not known whether the commands were received, or the downhole devices would or could properly respond to the commands. Accordingly, the position sensor 238 provides a positional status of the tubing exit sleeve 200 before further operations are commenced.

Should mechanical manipulation of the window sleeve 204 be necessary using conventional techniques such as coiled tubing tools, defined on an inner surface and adjacent a top end 240 is a retrieval fishneck 242. The retrieval fishneck allows manual manipulation of the exit-window sleeve 204 with a latching device carried by a coiled tubing unit, which is known to those skilled in the art.

Figure 4:
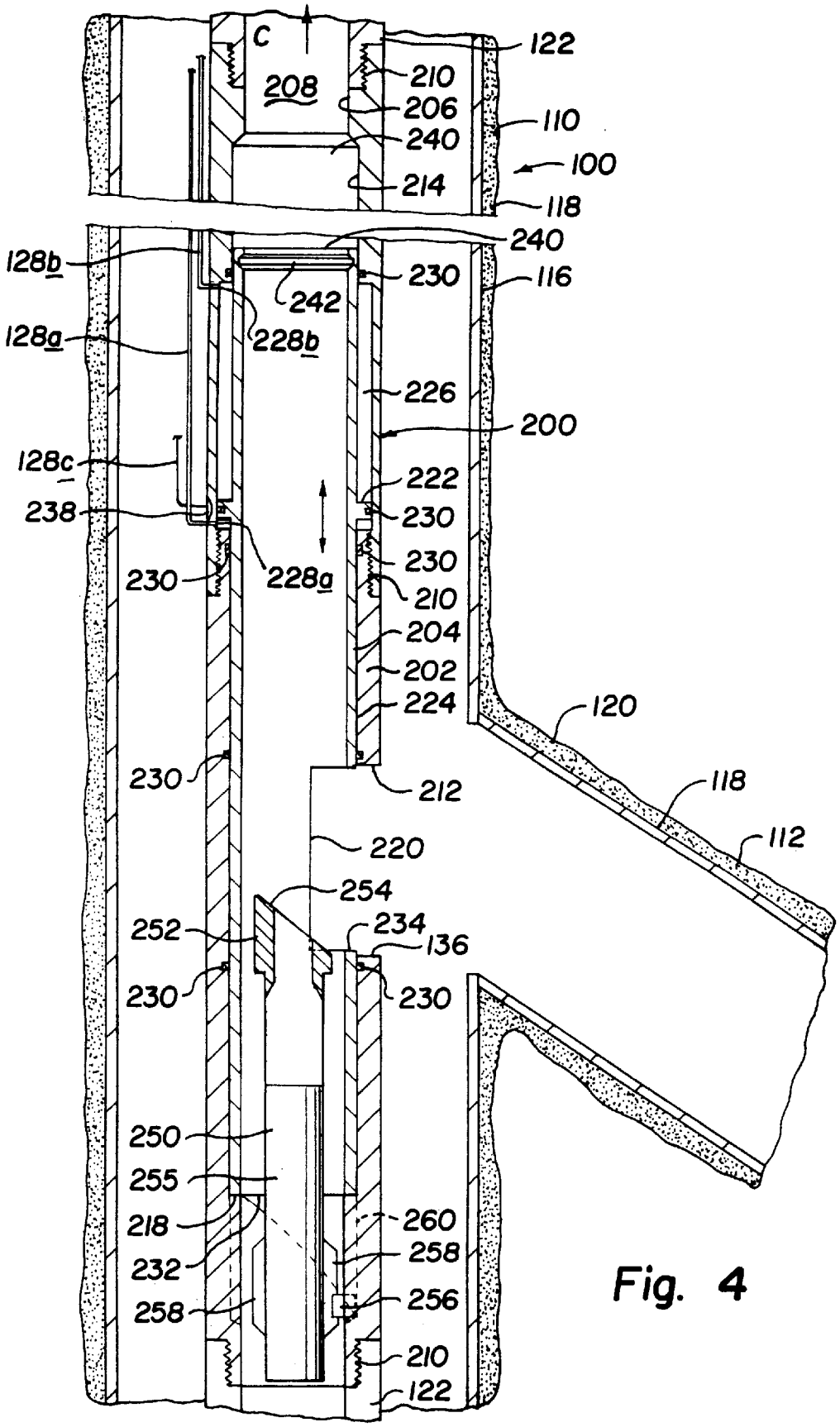
FIG. 4 is an enlarged cross-sectional schematic view of the tubing exit sleeve of the present invention deployed in an opened position.

FIG. 4 is an enlarged cross-sectional view of the tubing exit sleeve 200 of the present invention deployed in an opened position. From the surface 124 (see FIG. 1), hydraulic pressure is increased through the hydraulic input line 128*b* to urge the sleeve piston 222 downward, thus urging exit-window sleeve 204 to travel downward toward the shoulder 218, until the bottom end 232 of the exit-window sleeve 204 is adjacent the shoulder 218.

As shown, in the opened position the sleeve window 220 is substantially aligned with the side port 212 such that the inner bore 208 is in communication with the lateral wellbore 112. Preferably, the sleeve window 220 is sufficiently smaller than the side port 212 to minimize a well tool impinging the tubing body portion 202 when exiting the window 200, while being sized sufficient to allow passage of the well service tool.

The well tool referred to can be any number of devices used to service the lateral wellbore 112. For example, the well service tool can be a through-tubing inflatable packer used to perform temporary well bore isolation or fluid diversion during treatments, or the like. Also, it should be noted that the dimensions and the size are not meant to foreclose the use of other tools that may be developed at a later date.

A diverter 250 diverts a well tool for access to the lateral wellbore 112. A diverter is a device that is generally a long, slender, tapered steel wedge 252 with a concave groove on its inclined face 254. The diverter 250 is supported in the body portion 202, or the tubing string 122, using techniques known to those skilled in the art, such as a nipple profiles and mating key profile extending from the diverter stem 255, or the like.

As shown in FIGS. 2 and 4, an alignment key 256 extends from a centralizer 258, which aids in centralizing the stem 255 with respect to the tubing body portion 202. As the diverter 250 is lowered into the tubing body, it engages a diverter orientation-and-depth-control slot 260 defined in the inner bore 208. As the alignment key 256 engages the reception point 262 of the diverter slot 260, the inclined face 254 is oriented toward the window port 212, and at a depth relative to the body portion 202 sufficient to divert a well service tool from its course of travel toward the lateral wellbore 112. Further, the diverter 250 is "locked" with respect to the body portion 202 to provide a stationary support to divert a well tool toward the lateral wellbore 112. It should be noted that the diverter 250 can be either a permanent fixture or can be wireline deployed as needed.

Although the invention has been described with reference to a specific embodiment, these descriptions are not meant to be construed in a limiting sense. Various modifications of the disclosed embodiments, as well as alternative embodiments of the invention will become apparent to persons skilled in the art upon reference to the description of the invention. It is therefore contemplated that the claims will cover any such modifications or embodiments that fall within the true scope and spirit of the invention.

What is claimed is:

1. A downhole tubing exit-window assembly comprising:

a tubular body portion defining a side port that is sufficiently-sized to allow a well tool to pass therethrough; and a sleeve adjacent to said tubular body portion and reciprocatingly coupled about a longitudinal axis of said tubular body portion, said sleeve responsive to a remote command such that a sleeve window defined in a side of said sleeve can be substantially-aligned with said side port in an open relation such that a well tool can pass through said substantially-aligned sleeve window and side port.

2. The assembly of claim 1 further comprising:

a position sensor having an electrical output port, said position sensor secured to said tubular body portion such that a displacement of said sleeve with respect to said tubular body portion is sensed by said sensor, and said sensor transmits a signal corresponding to a displacement through said electrical output port.

3. The assembly of claim 2 wherein said position sensor senses a magnetic field source secured to said sleeve.

4. The assembly of claim 2 further comprises:

a diverter having a wedge fixed with respect to said tubular body portion adjacent said side port for diverting a well tool toward said substantially-aligned sleeve window and side port.

5. The assembly of claim 1 wherein said sleeve further comprises:

a piston extending from said sleeve; and a piston chamber defined in said body that receives said piston, said piston chamber for providing a pressure differential across said piston, wherein said sleeve window of said sleeve can be selectively urged into an open and closed position with respect to said side port of said body portion.

6. The assembly of claim 4 wherein said remote command is conveyed through a hydraulic fluid in communication with said sleeve.

7. The assembly of claim 1 wherein said sleeve further comprises:

a retrieval profile defined in said sleeve such that said sleeve can be mechanically-manipulated.

8. A method of selectively accessing a lateral wellbore of a multilateral well comprising the steps of:

providing a remote-controlled tubing exit sleeve in the multilateral well, the tubing exit sleeve having a body portion defining a side port and a reciprocating side-window sleeve received about an axis of the body portion and responsive to a remote command; and remotely positioning the side-window sleeve with respect to the body portion such that a well tool can access the lateral wellbore.

9. The method of selectively accessing a lateral wellbore of claim 8 wherein the step of remotely positioning the window sleeve includes the step of transmitting a remote command to the remote-controlled tubing sleeve.

10. The method of selectively accessing a lateral wellbore of claim 9 wherein the remote command is conveyed through a hydraulic fluid in communication with the remote-controlled tubing sleeve.

11. The method of selectively accessing of claim 8 further comprising the step of:

sensing a longitudinal position of the side-window sleeve with respect to the body portion.

12. The method of selectively accessing a lateral wellbore of claim 11 wherein the step of remotely positioning the window sleeve includes the step of transmitting a remote command to the remote-controlled tubing sleeve.

13. The method of selectively accessing a lateral wellbore of claim 12 wherein the remote command is conveyed through a hydraulic fluid in communication with the remote-controlled tubing sleeve.

14. A remote-controlled tubing exit sleeve comprising:

a body portion defining a side port and a reciprocating side-window sleeve received about an axis of said body portion and responsive to a remote command; and means for remotely positioning the side-window sleeve with respect to the body portion such that a well tool can access the lateral wellbore.

15. The remote-controlled tubing exit sleeve of claim 14 further comprising:

means for remotely-sensing a longitudinal displacement of the side-window sleeve with respect to the body portion.

16. A remote-controlled tubing exit sleeve comprising:

a tubular body portion defining a side port; and a hydraulically-driven sleeve defining a sleeve window, said sleeve reciprocatingly-received within said body portion such that said sleeve can reciprocate between an opened position and a closed position, wherein said sleeve window is substantially-aligned with said side port at said opened position for allowing external access from said body portion by a well tool.

17. The remote-controlled tubing exit sleeve of claim 16 further comprising:

a longitudinal-displacement sensor secured to said tubular body portion and said hydraulically-driven sleeve; and a receiver distally-coupled to said longitudinal-displacement sensor such that a longitudinal displacement of said hydraulically-driven sleeve with respect to said tubular body portion can be determined.

18. The remote-controlled tubing exit sleeve of claim 17 wherein said longitudinal-displacement sensor is receptive to a magnetic flux.

19. The remote-controlled tubing exit sleeve of claim 17 wherein said receiver is electrically-coupled with said longitudinal-displacement sensor.

20. The remote-controlled tubing exit sleeve of claim 17 wherein said receiver is acoustically-coupled with said longitudinal-displacement sensor.

* * * * *